United States Patent [19]

Pechard et al.

[11] 3,989,344

[45] Nov. 2, 1976

[54] TWO-POSITION CONTACT FOR PRINTED CIRCUIT CARDS

[75] Inventors: Lucien Pechard, Dole; Bernard Logerot, Mont-sous-Vaudrey; Jean-Pierre Huguenet, Dole, all of France

[73] Assignee: Bunker Ramo Corporation, Oak Brook, Ill.

[22] Filed: Dec. 26, 1974

[21] Appl. No.: 536,713

[52] U.S. Cl. ..... 339/176 MP; 339/217 S

[51] Int. Cl.[2] ..... H01R 13/42; H01R 33/76

[58] Field of Search ..... 339/17 L, 176 MP, 217 S

[56] References Cited

UNITED STATES PATENTS

| | | | |
|---|---|---|---|
| 3,517,374 | 6/1970 | Bonhomme | 339/176 MP |
| 3,555,494 | 1/1971 | Baumanis | 339/217 S |
| 3,587,029 | 6/1971 | Knowles | 339/176 MP |
| 3,626,361 | 12/1971 | Bonhomme | 339/217 S |

FOREIGN PATENTS OR APPLICATIONS

| | | | |
|---|---|---|---|
| 1,171,622 | 11/1969 | United Kingdom | 339/176 MP |

*Primary Examiner*—Roy Lake
*Assistant Examiner*—Neil Abrams
*Attorney, Agent, or Firm*—F. M. Arbuckle

[57] ABSTRACT

A two-position contact which can be used within a contact housing for making contact with single or double-faced printed circuit cards. The contact comprises an elongated shank having a flexible loop at one end for making contact with a printed circuit, and an opposite wiring end for joining the contact member to an electrical conductor. The flexible loop has a first contact portion on one side of the longitudinal axis of the contact member and a second contact portion on the other side of the longitudinal axis. The two contact portions are longitudinally spaced from each other. A pair of positioning tabs extend from the shank and a releasable spring catch secures the contact member longitudinally within the cavity. Two longitudinally different contact positions can be obtained by rotating the contact member 180°, without changing the longitudinal position of the wiring end of the contact member.

8 Claims, 3 Drawing Figures

TWO-POSITION CONTACT FOR PRINTED CIRCUIT CARDS

BACKGROUND OF THE INVENTION

1. Field of the Invention

This invention relates to contacts for use with insertable circuit boards, and more particularly to contacts having contact points which can be adjusted longitudinally within their housing.

2. Description of the Prior Art

In known devices of this type, a resilient lyre-shaped contact is secured within the cavity of a housing by engagement of the contact with a boss within the cavity. To adjust the longitudinal position of the contact, the entire contact member is moved longitudinally within the cavity and is secured to selected bosses which are spaced along the length of the cavity.

Such known devices cannot be used with both single-faced and double-faced printed circuit boards because of their lyre-shaped construction which is formed to optimize contact engagement on both sides of the board simultaneously by a single contact. Further, they require complex and expensive housings in order to provide cavities with suitable securing bosses. Additionally, the introduction and removal of the contact members by deformation of the body of the contact causes the connector to wear and limits the number of contact changes and adjustments in longitudinal position. Also, since the entire contact is moved within its housing, the position of the conductor joining end is changed each time the contact position is changed.

SUMMARY OF THE INVENTION

It is an object of the invention to provide an improved and economical two-position contact member. According to the invention, one end of the contact member has a flexible loop with two contact portions. One contact portion is on one side of the axis of the contact member, and the other contact position is on the other side of the axis. The two contact portions are spaced longitudinally from each other. Means extending from the contact member are provided to position and secure the contact member within a cavity having a pair of opposed bosses on opposite walls of the cavity. The contact member can be secured in the housing in one of two selected positions by rotating it 180° about its longitudinal axis. A different one of the two contact portions is engagable with the printed circuit card for each position.

Thus, two different contact positions can be obtained without changing the longitudinal position of the wiring end of the contact member. Further, the insertion and removal of a contact does not exert any excess stress upon the body of the contact member, thus permitting an unlimited number of contact replacements or contact position changes without damaging the contact member. Additionally, the housing can be readily formed by a simple molding procedure and is therefore less expensive to fabricate than prior art housings requiring relatively complex cavity configuration.

The contact member according to the invention can be utilized in a housing having a single cavity to contact one side of a printed circuit card, or two contact members can be utilized in a housing having a pair of contact cavities to contact both faces of a double-faced printed circuit card.

BRIEF DESCRIPTION OF THE DRAWINGS

The invention will now be described in detail with reference to the accompanaying drawings representing preferred embodiments of the contact member. In the drawings.

DESCRIPTION OF THE PREFERRED EMBODIMENTS

Figure 1:
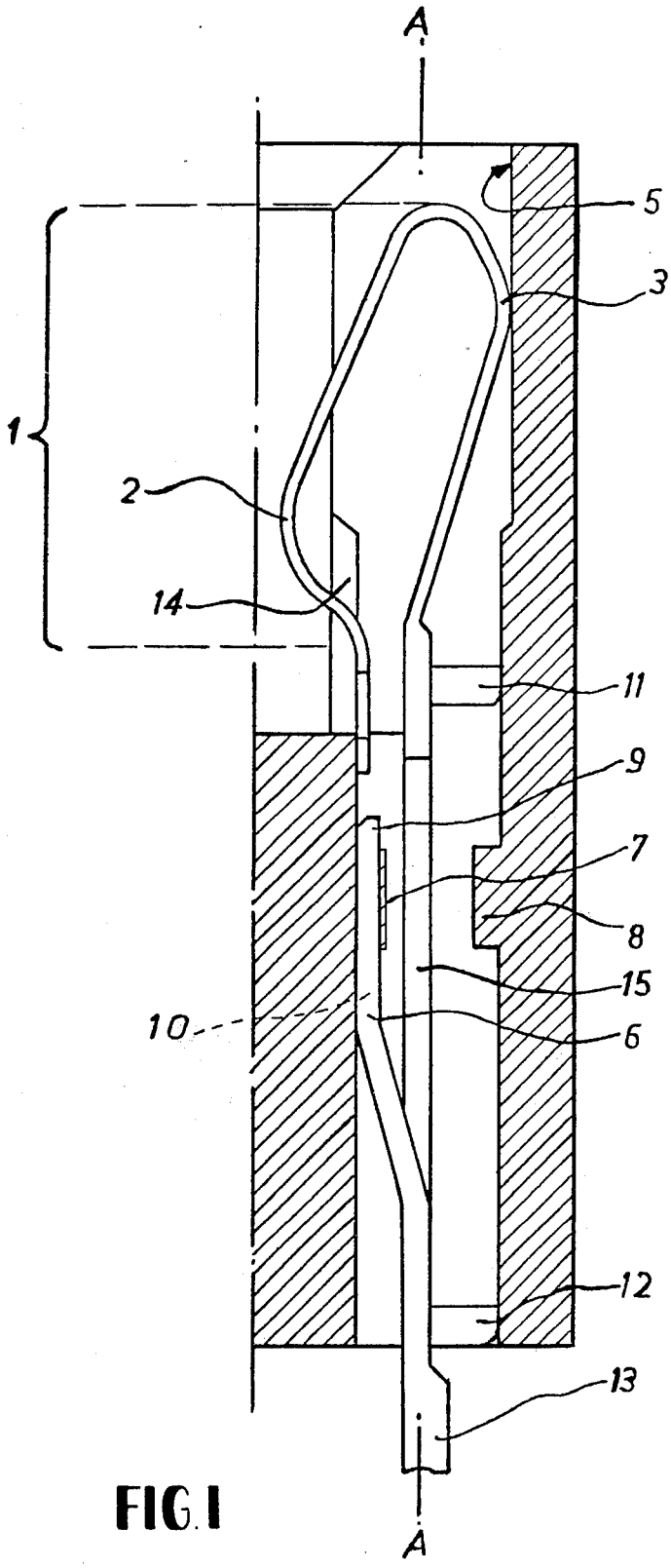
FIG. 1 is a side view of a section of a housing showing a contact member positioned in a cavity.
Figure 2:
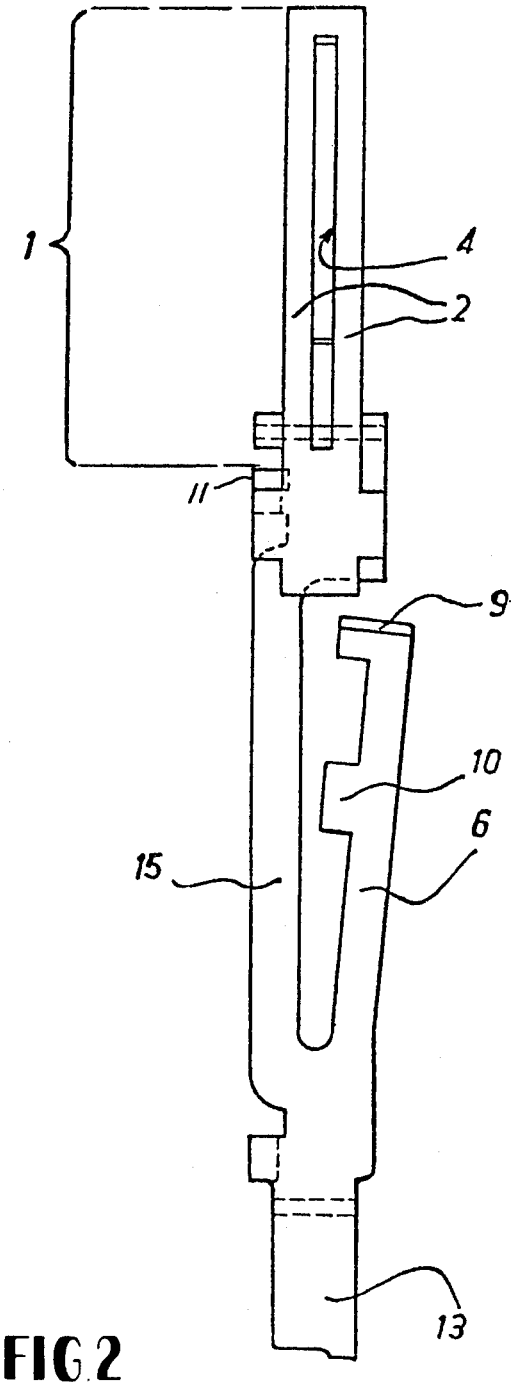
FIG. 2 is a front view of a contact member.
Figure 3:
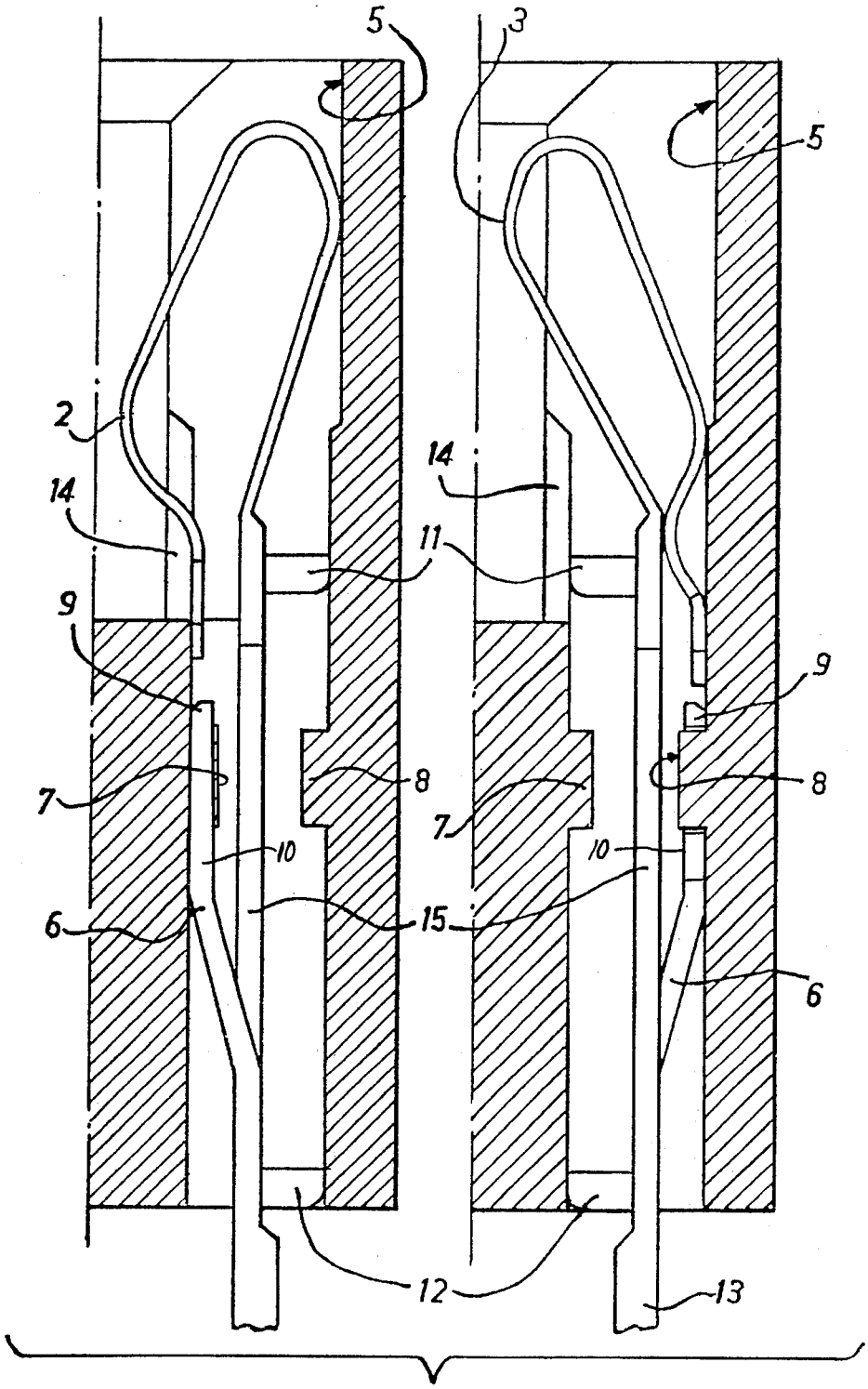
FIG. 3 is a side view of two-sectioned housings showing the contact member in two different preselected positions.

In the preferred embodiment, shown in FIGS. 1–3, a two-position contact member for either a single or double-ffaced printed circuit card is obtained in one piece by stamping and bending a conductive material having elastic properties which permit the forming of a spring bend or loop 1 with two contact portions 2, 3 of different longitudinal spacing. The elastic deformability of the contact portions is increased by using a strip of metal which is thinner in the loop portion than in the shank portion. As shown in FIG. 2, a slot 4 is cut longitudinally into each of the contact portions 2, 3 to provide a two-point electrical contact for each contact portion.

The contact member is lodged in the seating cavity 5 of the connector housing by inserting it from the front face of the connector housing (upper end A spring catch 6 (securing means) is provided to engage with a boss 7 or a boss 8 in the seating cavity. It includes a lug 9 preventing any downward movement and a lug 10 preventing any upward movement. By means of this catch, the contact member is thus secured in the longitudinal direction.

Tabs 11 and 12 (positioning means) provide correct guidance of the contact member during its introduction into the seating cavity and prevent its rotation with respect to the seating cavity. At the same time, the tabs 11 and 12 insure the correct positioning of the wiring end 13 of the contact member.

A part 14 of the seating cavity serves to support the tab 11 and secures the contact member with respect to rotation when the contact member is in a preselected position with contact portion 3 in position for engagement with one side of a printed circuit card. as shown in the right hand side of FIG. 3.

Changing the position of the active contact portion is done as follows: An appropriate tool is introduced into the seating cavity 5 in which a contact member is in place. The spring catch 6 of the contact is pinched to disengage it from the boss 7 (FIG. 1). While holding the spring catch 6 against the rigid shank 15 of the contact member from which it branches, the contact member can be easily extracted through the front (upper) face of the connector housing. Once the contact member is out of the seating cavity it is turned 180° and then reinserted into the seating cavity 5 until the spring catch 6 engages with the boss 8 (FIG. 3). The lower contact portion 2 is thus replaced by the higher contact portion 3 which is engagable with the printed circuit card as shown in FIG. 3.

The direction of introduction of the dismounting tool as well as the side of extraction of the contact member are given only by way of example and are in no way limiting.

The different component parts have been described as being all in one piece but they could, of course, be assembled from components.

From the foregoing, it can be readily realized that this invention can assume various embodiments. Thus, it is to be understood that the invention is not limited to the specific embodiments described herein, but is to be limited only by the appended claims.

What we claim is:

1. A connector for making electrical connection to an inserted printed circuit card comprising:

a housing having at least one cavity with a pair of opposed bosses on opposite walls of said cavity, said cavity being open at one end and having a printed circuit card opening spaced from one of said walls at the other end; and a contact member positioned within said cavity and comprising: an elongated shank having a contact end adjacent said printed circuit card opening for making contact with the printed circuit card, and a wiring end extending through said one end of said cavity for joining said contact member to an electrical conductor, said contact end having a flexible loop with a first contact portion on one side of said loop and facing in one direction away from the longitudinal axis of said shank and a second contact portion on the other side of said loop and facing in a direction opposite said one direction, a selected one of said contact portions being in an engagable position adjacent said printed circuit card opening, said second contact portion being longitudinally spaced from said first contact portion and closer to said wiring end;

releasable spring catch securing means branching from said shank in a transverse direction coinciding with said opposite direction and abutting a selected one of said pair of bosses to secure said contact member longitudinally within said cavity; and positioning means extending from said shank for positioning and preventing rotation of said contact member within a cavity in a housing, said positioning means comprising at lease one tab longitudinally spaced from said securing means near said contact end of said shank and at least one tab longitudinally spaced from said securing means near said wiring end of said shank, said tabs extending transversely from said shank in said one direction to abut against a wall of said cavity;

whereby said contact member can be secured in said housing in one of two selected positions, a first position with said first contact engagable with the circuit board and a second position rotated 180° about said longitudinal axis with said second contact engagable with the circuit board, thus providing an engagable contact at one of two selected longitudinal locations and a wiring end at a single longitudinal location.

2. The connector as recited in claim 1 wherein an end of each of said tabs and a point on said first contact position are engageable with a common wall in said housing when said contact member is secured in said housing in said second selected position, and wherein said ends of said tabs are engageable with a wall opposite to said common wall and a point in said second contact portion is engageable with said common wall when said contact member is secured in said housing in said first selected position.

3. The connector as recited in claim 1 wherein said releaseable spring catch securing means includes a pair of opposed lugs for abutting one of said bosses.

4. A contact member for making connection to printed circuit cards comprising an elongated shank having a contact end for making contact with a printed circuit and a wiring end for joining said contact member to an electrical conductor;

said contact end comprising a flexible loop having a first contact portion on one side of said loop and facing in one direction away from the longitudinal axis of said shank, and facing in a direction opposite said one direction, said second contact portion being longitudinally spaced from said first contact portion, said second contact portion being closer to said wiring end than said first contact portion;

releasable spring catch securing means branching from said shank in a transverse direction coinciding with said opposite direction for longitudinally securing said contact member within the cavity of the housing; and positioning means extending from said shank for positioning and preventing rotation of said contact member within a cavity in a housing, said positioning means comprising at least one tab longitudinally spaced from said securing means near said contact end of said shank and at least one tab longitudinally spaced from said securing means near said wiring end of said shank, said tabs extending transversely from said shank in said one direction to abut against a wall of said cavity;

whereby said contact member can be secured in the housing in one of two selected positions, a first position with said first contact portion engagable with the circuit board and a second position rotated 180° about said longitudinal axis with said second contact portion engagable with the circuit board, thus providing an engagable contact point at one of two selected longitudinal locations and a wiring end at a single longitudinal location.

5. The contact member as claimed in claim 4, wherein each portion of said loop forming said first and second contact portions is slotted longitudinally, whereby said first and second contact portions each have double contact surfaces.

6. The contact member as claimed in claim 4, wherein said flexible loop is a spring loop.

7. The contact member is recited in claim 4, wherein said releasable spring catch securing means includes a pair of opposed lugs for abutting a boss formed in the wall of the cavity.

8. The contact member as recited in claim 4 wherein an end of each of said tabs and a point on said first contact portion are engagable with a common wall in said housing when said contact member is secured in said housing in said second selected position.

* * * * *